United States Patent [19]

Goldin et al.

[11] Patent Number: 4,533,139

[45] Date of Patent: Aug. 6, 1985

[54] NON-SLIP HANDLE WITH CODING MEANS

[76] Inventors: Abraham Goldin, 18 Russel Rd., North Haven, Conn. 06473; Andrew G. Rodau, 17 Madison Ave. #11, Madison, N.J. 07940

[21] Appl. No.: 490,438

[22] Filed: May 2, 1983

[51] Int. Cl.[3] ..... A63B 49/08

[52] U.S. Cl. ..... 273/73 J; 273/75

[58] Field of Search ..... 273/735, 75, 81 R; 128/401, 402, 403; 222/5

[56] References Cited

U.S. PATENT DOCUMENTS

| | | | |
|---|---|---|---|
| 2,016,113 | 10/1935 | Lambert et al. | 222/5 |
| 2,120,280 | 6/1938 | Hall | 273/75 |
| 2,335,630 | 11/1943 | Bachardy | 2/7 |
| 2,442,648 | 6/1948 | Goldman | 222/5 |
| 2,628,130 | 2/1953 | Knapp | 222/5 |
| 3,175,558 | 3/1965 | Caillovette et al. | 128/403 |
| 3,614,100 | 10/1971 | Spitz | 273/75 |
| 3,645,008 | 2/1972 | Dellsack | 34/81 |
| 3,858,567 | 1/1975 | Slogaski | 126/206 |
| 4,082,276 | 4/1978 | Szafianski | 273/75 |
| 4,118,946 | 10/1978 | Tubin | 128/403 |

FOREIGN PATENT DOCUMENTS

| | | | |
|---|---|---|---|
| 1927468 | 12/1977 | Fed. Rep. of Germany | 273/735 |
| 719820 | 8/1968 | France | 273/735 |

*Primary Examiner*—Richard C. Pinkham
*Assistant Examiner*—Matthew L. Schneider
*Attorney, Agent, or Firm*—Andrew G. Rodau

[57] ABSTRACT

A non-slip handle for a hand held device, such as a tennis racket, which consists of a longitudinal opening in the center of the handle into which some cooling mechanism, such as a pressurized carbon dioxide gas container, a chemical mixture or dry ice, is inserted. Transverse openings or conducting members extending from the surface of the handle to the longitudinal opening allow the cooling mechanism to maintain the handle surface at a cool temperature reducing perspiration and resultant slippage.

1 Claim, 6 Drawing Figures

NON-SLIP HANDLE WITH CODING MEANS

BACKGROUND OF THE INVENTION

This invention relates to handles designed to be grasped by a person. Cooling apparatus can be incorporated into a handle so that a satisfactory grip can be maintained on the handle despite temperature changes.

Vigorous activities or warm ambient temperatures can cause excessive perspiration which would make it difficult for a person to adequately maintain a grip on the handle of a device such as a tennis racket.

The existing methods of cooling a tennis racket handle utilize a fan or a cartridge of moisture absorbing material placed inside the handle. Another method is the use of air channels through which cooling air is forced by the motion of the racket.

The effectiveness of a fan is limited by size constraints placed on it by the overall dimensions of the handle. Additionally, the vibration associated with the use of a device such as a tennis racket greatly increases the likelihood of a mechanical or electrical failure.

A moisture absorbing material will only absorb the perspiration after it has been created on the contact surface between the user's hand and the racket handle.

The use of an air channel through which air is forced by racket motion does not prevent the creation and accumulation of perspiration on the handle due to warm ambient air when the racket is not in motion.

SUMMARY OF THE INVENTION

This invention overcomes the short comings of existing non-slip handles by providing a highly effective cooling apparatus which can easily be constructed from readily available components.

In general, the invention features a non-slip handle which has a shaft for a hand to grasp, the shaft having portions defining a hollow, first means for cooling located in the hollow, the first means having at least one chemical, and second means for the first means to communicate with the exterior surface of the shaft.

In a particular embodiment the handle has second means having a plurality of openings which provide continuous passages between the hollow and the exterior surface of the shaft.

In other embodiments, the handle has second means having a conducting medium which provides a continuous conduction path between the hollow and the exterior surface of the shaft; the conducting medium is a plurality of metallic members extending between the hollow and the exterior surface of the shaft; the conducting medium further has a metallic liner for the hollow which is in conductive contact with the metallic members; metallized portions of the exterior surface are in conductive contact with the metallic members whereby a continuous conductive path exists between the hollow and the exterior surface of the shaft.

In other embodiments, the chemical in the shaft is carbon dioxide; the first means includes a container for the carbon dioxide and means for controllably releasing the carbon dioxide from the container; the means for releasing is a valve.

In other embodiments, the first means further includes a first chemical, a second chemical, and means to control contact between the first and second chemicals, wherein contact between the chemicals produces an endothermic reaction.

Other features and advantages of the invention will be apparent from the following detailed description, and from the claims.

For a full understanding of the present invention, reference should now be made to the description of the drawings, the detailed description of the invention and to the accompanying drawings.

DETAILED DESCRIPTION

Figure 1:
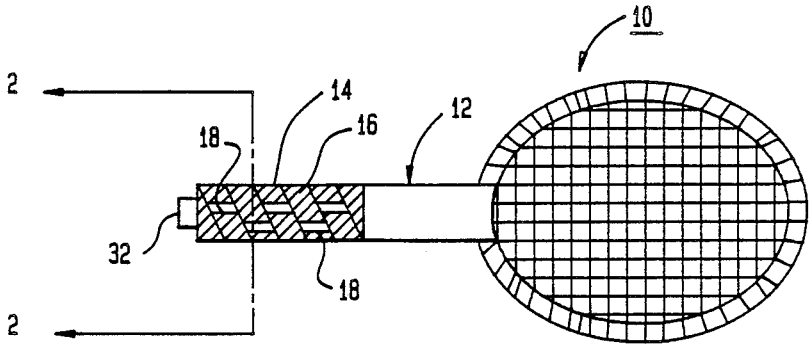
FIG. 1 is diagrammatic view of an embodiment of the invention.

Referring to FIG. 1, tennis racket 10, with shaft 12 and a non-slip handle 14, is shown. Handle 14, designed to be held by the user, is covered by leather wrap 16 which contains metalized surfaces 18 dispersed throughout the length of the wrap.

The center of the shaft, which is hollow, houses carbon dioxide cartridge 20. The hollow portion of the shaft is lined with cylindrical metal liner 22, which extends the full length of handle 14. Metal conducting studs 24, attached to the metal liner, extend radially outward from the liner. These studs are also attached to metallized surfaces 18.

Figure 3:
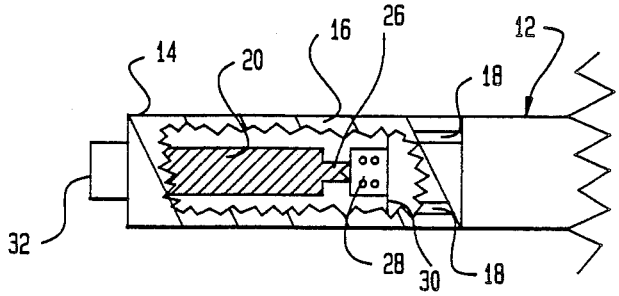
FIG. 3 is a diagrammatic view of FIG. 1, partially cut away, showing the cooling apparatus of FIG. 1.

Referring to FIG. 3, the location of cartridge 20 is shown in more detail. The cartridge has a puncturable opening 26 at one end, into which valve 28, supported by member 30, fits. End cap 32 (shown in FIG. 1) attaches to the end of the shaft and holds cartridge 20 in place against the valve.

The operation of the non-slip handle will now be described with reference to FIGS. 1–3.

Carbon dioxide cartridge 20 is placed into the hollow portion of shaft 12 so that puncturable opening 26 contacts valve 28. The end cap which is then fastened to the end of the shaft, forces the cartridge onto the valve puncturing opening 26. The cap then holds the cartridge in place on the valve and closes the hollow so the carbon dioxide gas cannot escape from the interior of the shaft. The valve controls the release of gas from cartridge 20 and directs the released gas into the space between the cartridge and metal liner 22. The gas maintains the metal liner at a temperature below the surface temperature of the racket user's hand. Therefore, heat generated in the user's hand is conducted to the metal liner by the heat conduction path created by the connection of metallized surfaces 18, studs 24 and metal liner 22.

In an alternate embodiment, dry ice can be placed in the hollow portion of the shaft in place of the carbon dioxide cartridge and the valve. The dry ice will sublimate from its solid state to a gaseous state spontaneously.

Figure 4:
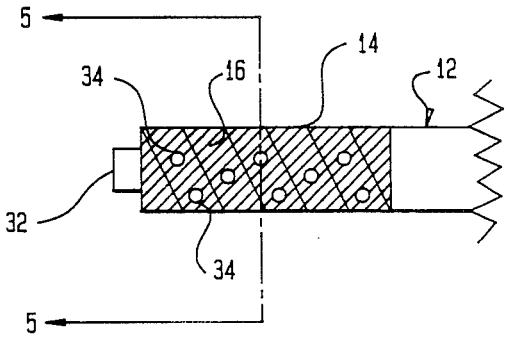
FIG. 4 is a cutaway diagrammatic view of another embodiment of the invention.
Figure 5:
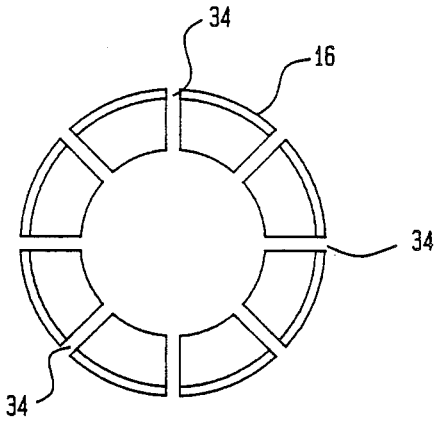
FIG. 5 is a sectional view taken along line 5—5 of FIG. 4.

In another alternate embodiment, shown in FIGS. 4 and 5, a plurality of passages 34 extend from the hollow portion of shaft 12 to the surface of leather wrap 16. The cartridge and valve shown in FIG. 3 or dry ice can be utilized in this embodiment to provide gaseous carbon dioxide. This gas will flow through passages 34 to the surface of the handle to cool the users hand.

Figure 6:
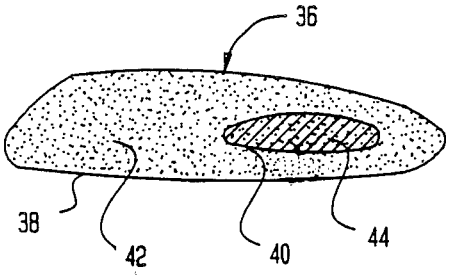
FIG. 6 is a sectional view of a container for holding chemicals which produce an endothermic reaction.

In another embodiment, carbon dioxide cartridge 20 and valve 28 (shown in FIGS. 2 and 3) can be replaced with plastic chemical package 36, shown in FIG. 6. The chemical package has an outer flexible plastic covering 38 and an inner flexible plastic container 40, which keep chemicals 42 and 44 insulated from each other. When the inner container is broken chemicals 42 and 44 come in contact and produce an endothermic reaction. This package is then inserted into the hollow portion of shaft 12 and the metal liner which is cooled by contact with the chemical package conducts heat away from the users hand. A typical chemical package for producing an endothermic reaction is disclosed in U.S. Pat. No. 3,175,558.

In another alternate embodiment, metal liner 22 can also be a structural member for strengthening or stiffening shaft 12.

There has thus been shown and described a novel non-slip handle which fulfills all the objects and advantages sought therefore. Many changes, modifications, variations and other uses and applications of the subject invention will, however, become apparent to those skilled in the art after considering the specification and the accompanying drawings which disclose embodiments thereof. All such changes, modifications, variations and others uses and applications which do not depart from the spirit and scope of the invention are deemed to be covered by the invention which is limited only by the claims which follow.

What is claimed is:

1. A sporting implement having a non-slip handle, said non-slip handle comprising:

(a) a shaft for a hand to grasp, said shaft having portions defining a hollow;

(b) a valve located in said hollow;

(c) a replaceable pressurized cylindrical carbon dioxide gas container located in said hollow;

(d) an end cap which holds said carbon dioxide gas container in said hollow and forces said pressurized carbon dioxide container into puncturable contact with said valve; and (e) means for cooling said shaft's exterior surface with said carbon dioxide gas controllably released from said pressurized carbon dioxide container by said valve, wherein said means for cooling includes conducting means which provides a continuous conduction path between said hollow and said exterior sufface of said shaft, said conducting means comprising:

(1) a plurality of metallic members extending between said hollow and said exterior surface of said shaft;

(2) a metallic liner for said hollow, said metallic members being in conductive contact with said liner; and (3) metallized portions of said exterior surface, said metallized portions being in conductive contact with said metallic members, so that said continuous conductive path exists between said hollow and said exterior surface of said shaft.

* * * * *

UNITED STATES PATENT AND TRADEMARK OFFICE

CERTIFICATE OF CORRECTION

PATENT NO. : 4,533,139
DATED : August 6, 1985
INVENTOR(S) : Goldin et al.

It is certified that error appears in the above—identified patent and that said Letters Patent is hereby corrected as shown below:

In the title substitute --COOLING-- for "CODING"

Figure 2:
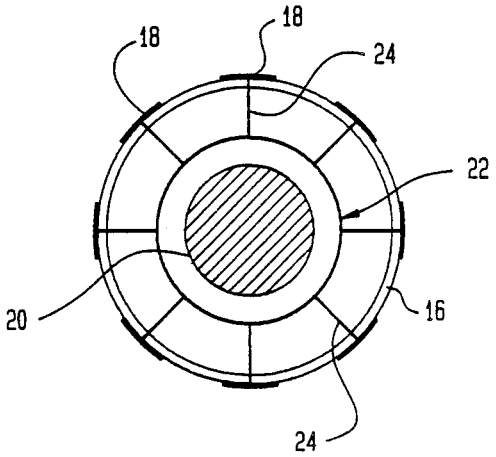
FIG. 2 is a sectional view taken along line 2—2 of FIG. 1.

In Column 2, line 29, add the following before "The center":
--Referring to Fig. 2, a cross section of the handle is shown.--

Signed and Sealed this

First Day of October 1985

[SEAL]

*Attest:*

DONALD J. QUIGG

*Attesting Officer*

*Commissioner of Patents and Trademarks—Designate*